US007247780B2

(12) United States Patent
Sanders et al.

(10) Patent No.: US 7,247,780 B2
(45) Date of Patent: Jul. 24, 2007

(54) WRENCH TREMOLO BAR FOR A GUITAR

(76) Inventors: Peter J. Sanders, 2009 Limestone La., Carpentersville, IL (US) 60110; Brian A. Strociek, 599 Trout Park Blvd., Elgin, IL (US) 60120

( * ) Notice: Subject to any disclaimer, the term of this patent is extended or adjusted under 35 U.S.C. 154(b) by 202 days.

(21) Appl. No.: 11/096,655

(22) Filed: Apr. 1, 2005

(65) Prior Publication Data

US 2006/0219086 A1 Oct. 5, 2006

(51) Int. Cl.
*G10D 3/14* (2006.01)

(52) U.S. Cl. ..... 84/313; 84/318; 84/458

(58) Field of Classification Search ..... 84/313, 84/458; 7/138
See application file for complete search history.

(56) References Cited

U.S. PATENT DOCUMENTS 2,678,578 A * 5/1954 Bonanno ..... 81/436
3,706,254 A * 12/1972 Morin ..... 84/458
4,475,432 A * 10/1984 Stroh ..... 84/314 N
4,505,177 A * 3/1985 Schaller ..... 84/329
4,579,033 A * 4/1986 Edwards ..... 84/314 N
4,604,936 A * 8/1986 Page et al. ..... 84/313
4,611,523 A * 9/1986 McFarland ..... 84/313
4,632,005 A * 12/1986 Steinberger ..... 84/313
4,649,788 A * 3/1987 Matsui ..... 84/297 R
4,656,916 A * 4/1987 Gressett, Jr. ..... 84/313
4,667,561 A * 5/1987 Storey et al. ..... 84/314 N
4,669,350 A * 6/1987 Gressett et al. ..... 84/314 N
4,677,891 A * 7/1987 Gressett et al. ..... 84/313
4,681,011 A * 7/1987 Hoshino et al. ..... 84/313
4,688,461 A * 8/1987 Stroh ..... 84/298
4,768,415 A * 9/1988 Gressett et al. ..... 84/298
RE32,863 E * 2/1989 Edwards ..... 84/314 N
4,852,448 A * 8/1989 Hennessey ..... 84/313
4,897,117 A * 1/1990 Penrice ..... 75/248
4,967,631 A * 11/1990 Rose ..... 84/313
5,046,393 A * 9/1991 Xenidis ..... 84/313
5,127,300 A * 7/1992 Silverman ..... 84/329
D342,001 S * 12/1993 Hibbert ..... D8/29
5,299,485 A * 4/1994 Denton ..... 84/329
5,305,675 A * 4/1994 Lasner ..... 84/313
5,337,842 A * 8/1994 Robinson ..... 175/323
5,357,643 A * 10/1994 Seals ..... 7/138
5,359,144 A * 10/1994 Benson ..... 84/313
5,413,019 A * 5/1995 Blanda, Jr. ..... 84/298
5,544,379 A * 8/1996 Chen ..... 7/138
5,553,340 A * 9/1996 Brown, Jr. ..... 7/118
RE35,424 E * 1/1997 Seals ..... 7/138
5,637,817 A * 6/1997 Sherman ..... 84/313
5,637,818 A * 6/1997 Fishman et al. ..... 84/313
5,696,341 A * 12/1997 McCane ..... 84/453
5,701,714 A * 12/1997 Dietrichs ..... 52/665
5,932,822 A * 8/1999 Bernstein ..... 84/314 N
5,945,615 A * 8/1999 Rose ..... 84/297 S
D421,882 S * 3/2000 Mattei ..... D8/29

(Continued)

*Primary Examiner*—Lincoln Donovan
*Assistant Examiner*—Robert W. Horn
(74) *Attorney, Agent, or Firm*—Mathew R. P. Perrone

(57) ABSTRACT

A guitar has a wrench tremolo bar thereon, replacing the standard tremolo bar, with the wrench tremolo bar having a desired wrench on at least one end of the wrench tremolo bar, to cooperate with the string fasteners on the guitar, which greatly facilitates tuning, changing or replacing of a guitar string.

12 Claims, 5 Drawing Sheets

U.S. PATENT DOCUMENTS 6,255,575 B1 * 7/2001 Pearse ..... 84/458
6,279,434 B1 * 8/2001 Brown ..... 81/437
6,294,719 B1 * 9/2001 Palecki et al. ..... 84/458
6,639,137 B2 * 10/2003 Lauer ..... 84/453
6,797,870 B2 * 9/2004 Kang ..... 84/313
6,865,760 B2 * 3/2005 Oberndorfer ..... 7/138
2003/0217623 A1 * 11/2003 Brown ..... 81/437
2004/0094014 A1 * 5/2004 Kang ..... 84/313
2004/0177741 A1 * 9/2004 Hirayama ..... 84/313
2006/0150798 A1 * 7/2006 Tafolla ..... 84/327
2006/0219086 A1 * 10/2006 Sanders et al. ..... 84/455

* cited by examiner

WRENCH TREMOLO BAR FOR A GUITAR

This invention relates to a tremolo bar for a guitar, and more particularly, to a wrench tremolo bar for a guitar, which includes a wrench or a tool on each end of the tremolo bar in order to facilitate tuning, changing or replacing of a guitar string.

BACKGROUND OF THE INVENTION

A guitar is a very popular musical instrument. Both professionals and amateurs enjoy playing a guitar. Use of a guitar creates wear and tear on the guitar strings. Such wear and tear eventually leads to breakage of the string.

Since replacing a broken string requires a tool, it is very handy to have the tool readily available. Then, a string replacement can be done efficiently. However, most typically, tools are not readily available. For example, the tool may be in the guitar case or the dressing room. The tool may not even be around.

A delay in changing a broken guitar string is very expensive and time-consuming for a professional musician or guitar player. Any delay clearly interferes with rehearsal time. That delay is compounded when the string break occurs during a performance. An efficient replacement of a broken string on a guitar is very desirable.

Furthermore, recording studio time is very expensive. Any downtime must still be covered. So a broken guitar string does not stop the clock on recording studio time. Thus, the more quickly the string can be replaced, the better off everyone involved will be.

With the consideration of FIG. 1 and FIG. 2, the status of the guitar 112 with a standard tremolo bar 110 in position thereon becomes clear. Standard tremolo bar 110 has male mounting threads 108 (FIG. 5) at one end thereof. Male mounting threads 108 permit attachment to the guitar 112 at female guitar threads 102 (FIG. 5), because of the structure of guitar 112. In this manner, the standard tremolo bar 110 carries out its normal function of making a desired change in the sound of the guitar 112 as desired.

SUMMARY OF THE INVENTION

Among the many objectives of this invention is the provision of a tremolo bar for a guitar, which permits changing a broken guitar string in efficient fashion.

A further objective of this invention is the provision of a tremolo bar for a guitar, which reduces downtime at a recording studio.

Yet a further objective of this invention is the provision of a tremolo bar for a guitar, which provides more efficient rehearsal time.

A still further objective of this invention is the provision of a tremolo bar for a guitar, which is easily installed.

These and other objectives of the invention (which other objectives become clear by consideration of the specification, claims and drawings as a whole) are met by providing a tremolo bar for a guitar, having a desired wrench on at least one end thereof.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

In a guitar using a tremolo bar where the strings are held in position by screws or bolts or other fasteners, there are usually no more than two sizes thereof holding the strings. Therefore, when strings need to be replaced, only two different size tools are needed to make the appropriate adjustments in the screws or bolts.

The tremolo bar, also sometimes referred to as the whammy bar, for this invention has the desired tool on either end thereof. For example, when a guitar has Allen screws holding the strings, the Allen wrench on either the end of the tremolo bar can be accessed by removing it from the guitar and using the wrench on the end thereof to replace the string. This tremolo bar also facilitates fine tuning of the string at the neck of the guitar.

While it is unusual for a screw to be removed from the guitar during the process of changing a string, it is possible. To that end, it is possible to magnetize the wrench tremolo bar, to thereby minimize the chance of losing the screw. If the that screw is accidentally or purposefully removed, the this magnetic quality will hold the screw on the wrench tremolo bar until it may be reinserted into the guitar.

Figure 1:
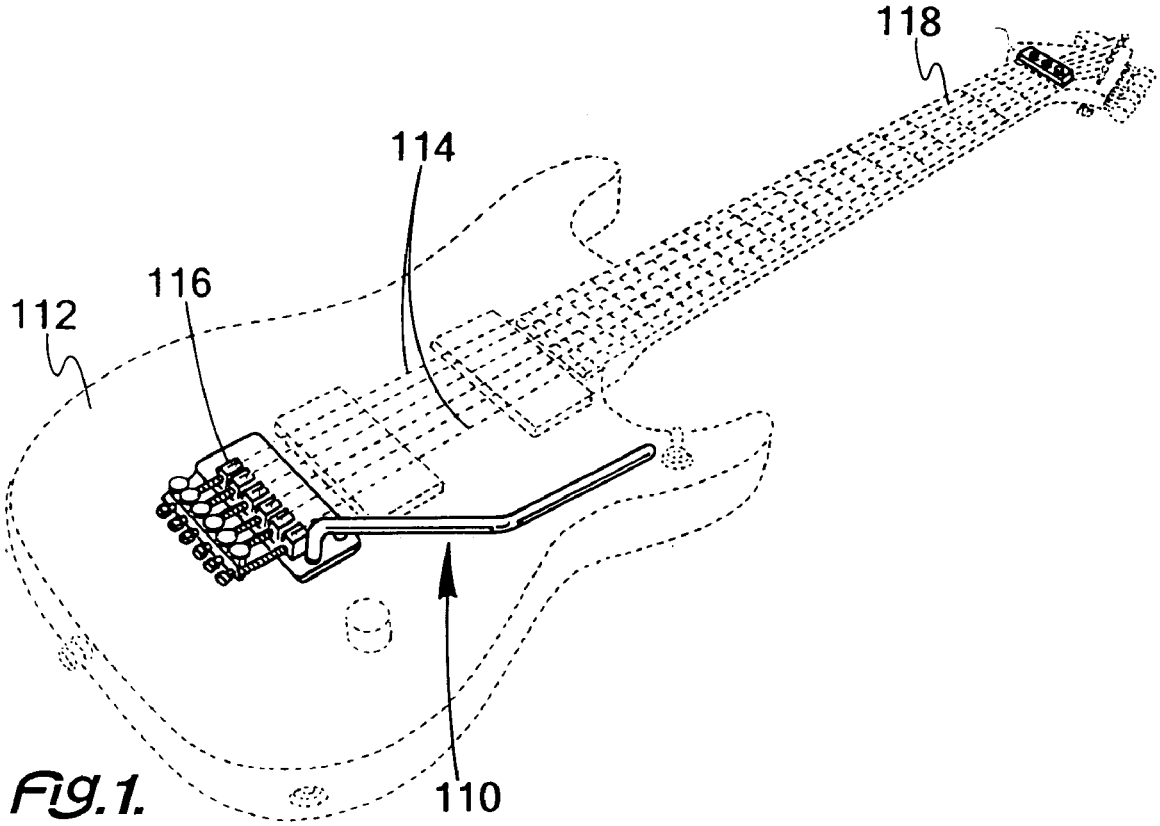
Fig.1. Prior Art
FIG. 1 depicts a perspective view of a prior art standard tremolo bar 110, in position on a guitar 112.
Figure 2:
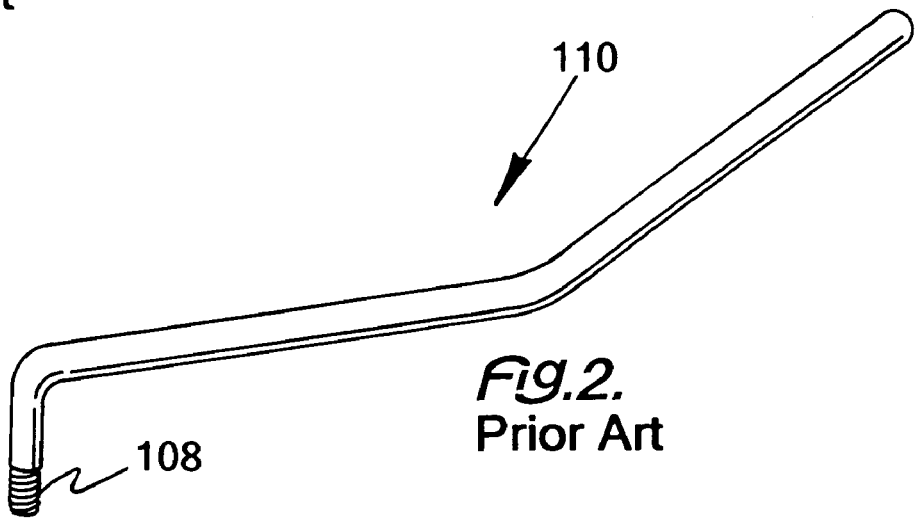
Fig.2. Prior Art
FIG. 2 depicts a side view of a prior art standard tremolo bar 110 based on FIG. 1.
Figure 3:
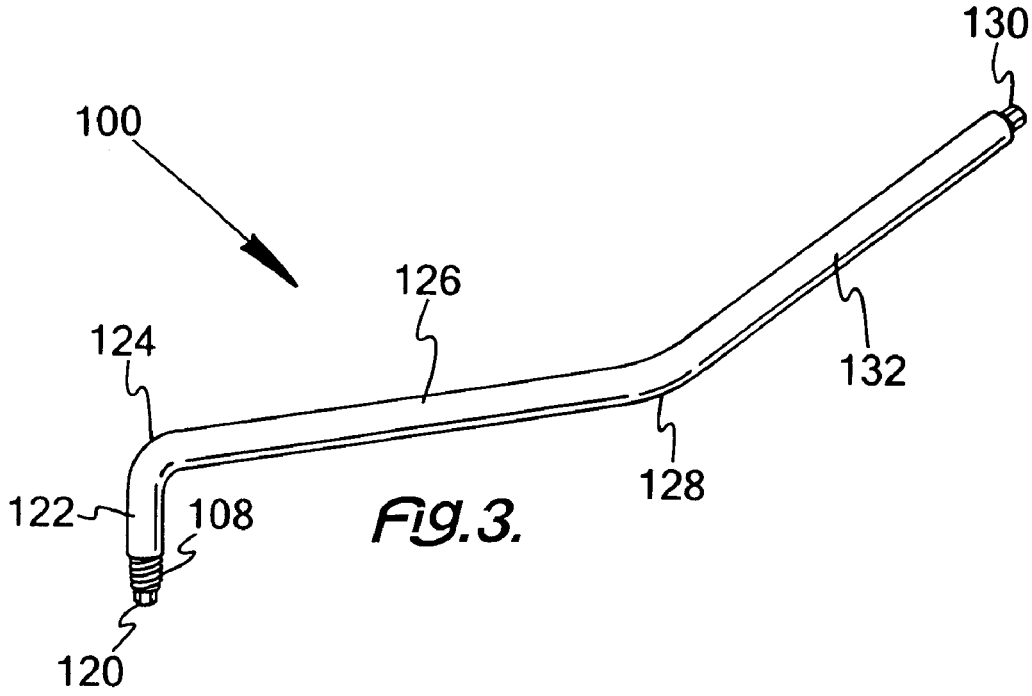
FIG. 3 depicts a perspective view of the wrench tremolo bar 100 of this invention.
Figure 4:
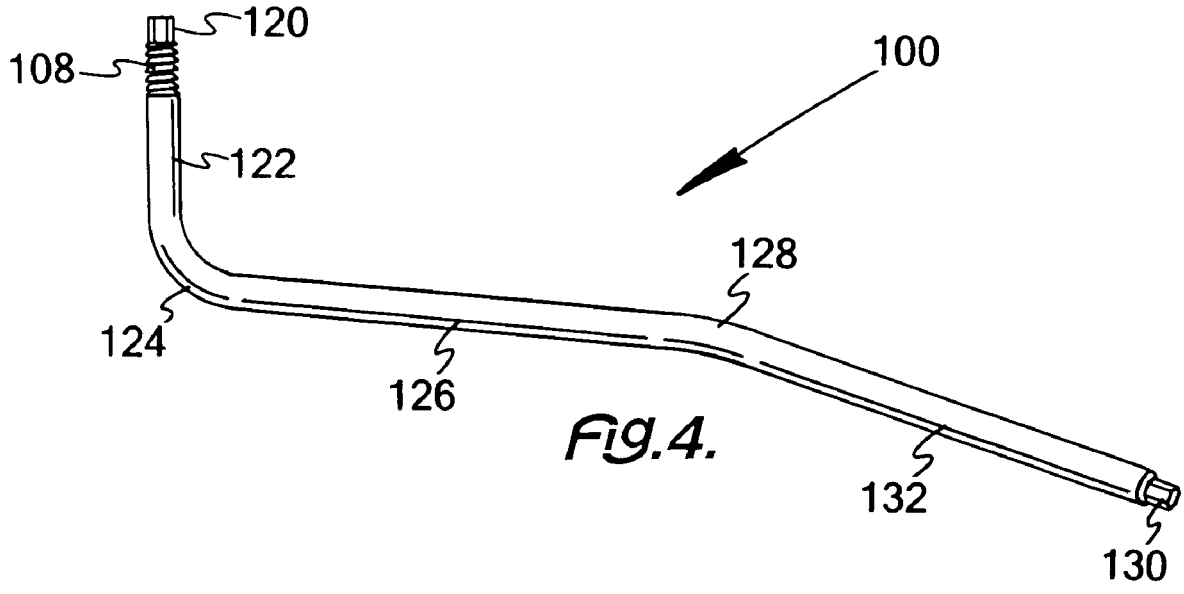
FIG. 4 depicts a perspective view of the wrench tremolo bar 100 of this invention, which is a reverse view of FIG. 3.

Referring now to FIG. 3 and FIG. 4, the wrench tremolo bar 100 has a neck Allen wrench 120 at mounting threads 108 and a bridge Allen wrench 130 at the opposing end of wrench tremolo bar 100. Mounting threads 108 still retain sufficient length to permit wrench tremolo bar 100, with neck Allen wrench 120 at the end thereof to permit attachment to guitar 112 at female guitar threads 102 (FIG. 5).

More particularly, wrench tremolo bar 100 has a short straight shaft end 122 adjacent to mounting threads 108. Wrench tremolo bar 100 has the short straight shaft end 122 extending into a substantially right angle 124. From substantially right angle 124, wrench tremolo bar wrench 100 extends into a tool bar 126. Tool bar 126 leads into slight bend 128. Slight bend 128 leads to bridge Allen wrench 130 through long straight shaft end 132.

Figure 5:
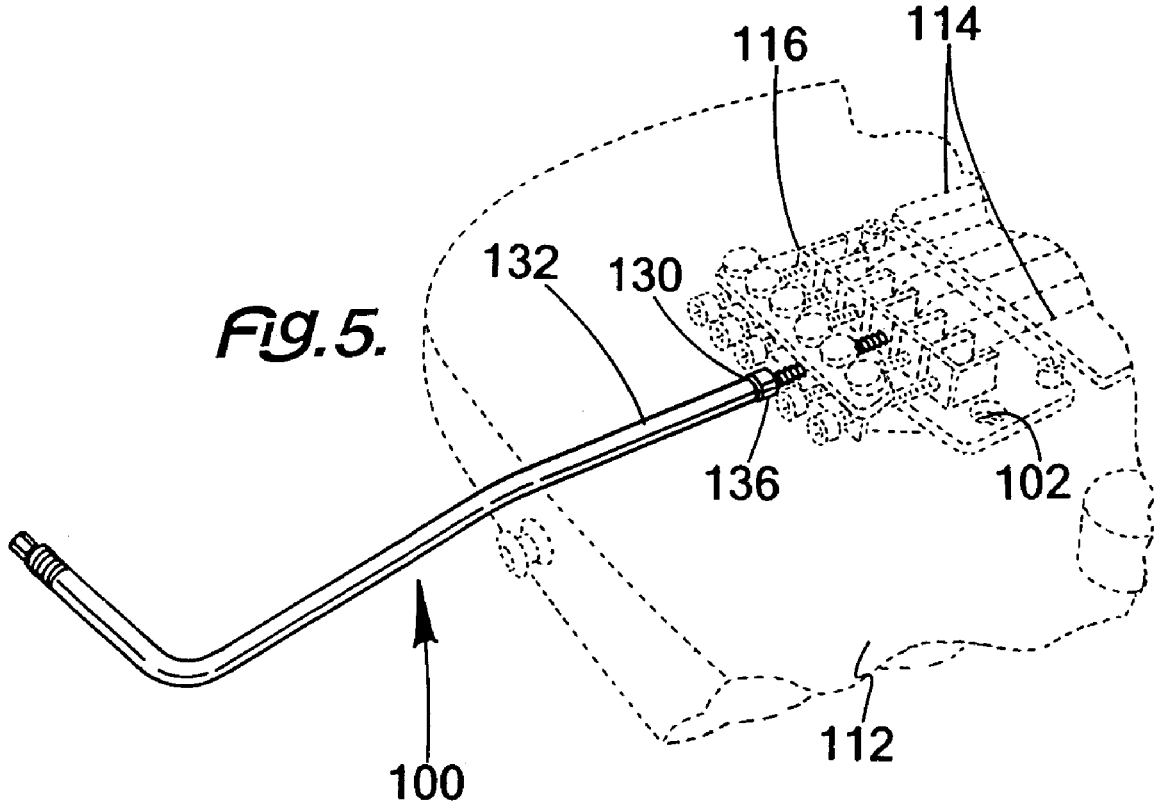
FIG. 5 depicts a perspective view of the wrench tremolo bar 100 of this invention, working to replace a string 114 on guitar 112 from the lockdown bridge 116.

With FIG. 5 added to the consideration, bridge Allen wrench 130 is used on bridge Allen screw 136 in order to release or tighten Allen screw 136 and related guitar string 114. Long straight shaft end 132 permits ease of access to Allen screw 136. In this manner, guitar string 114 may be tightened, loosened or replaced. After such use, the wrench tremolo bar 100 at male threads 108 is received into female guitar threads 102.

Figure 6:
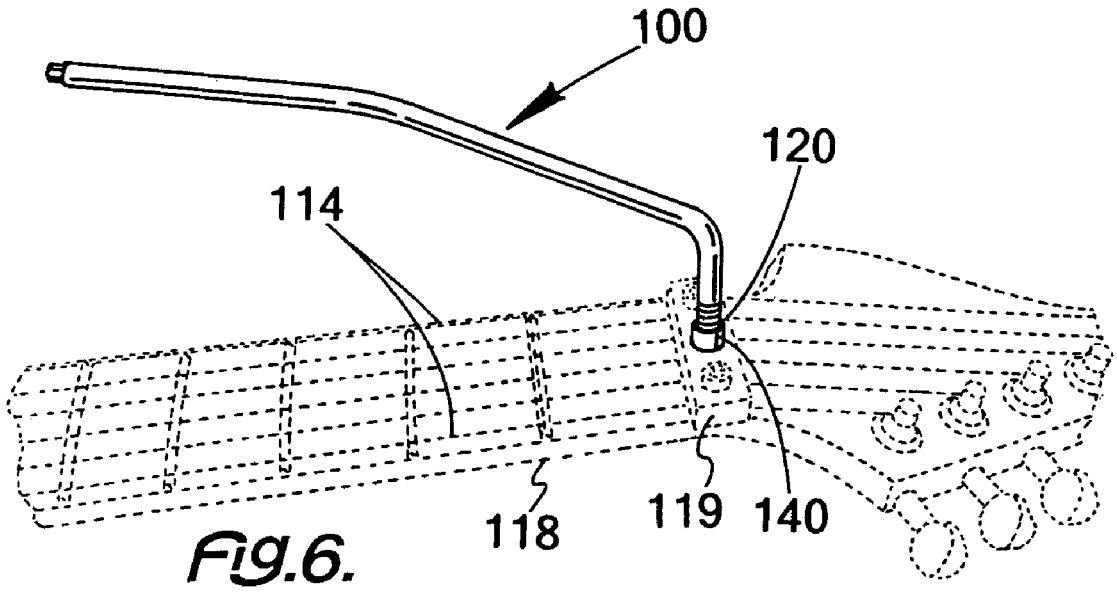
FIG. 6 depicts a perspective view of the wrench tremolo bar 100 of this invention, working to replace a string 114 on guitar 112 from the guitar neck 118.

Turning now to FIG. 6, neck Allen wrench 120 is used on neck Allen screw 140 in order to release or tighten neck Allen screw 140 and related guitar string 114. Tool bar 126 of wrench tremolo bar 100 permits ease of access to neck Allen screw 136 of nut lock 119 at the end of guitar neck 118. In this manner, guitar string 114 may be tightened loosened or replaced.

Figure 7:
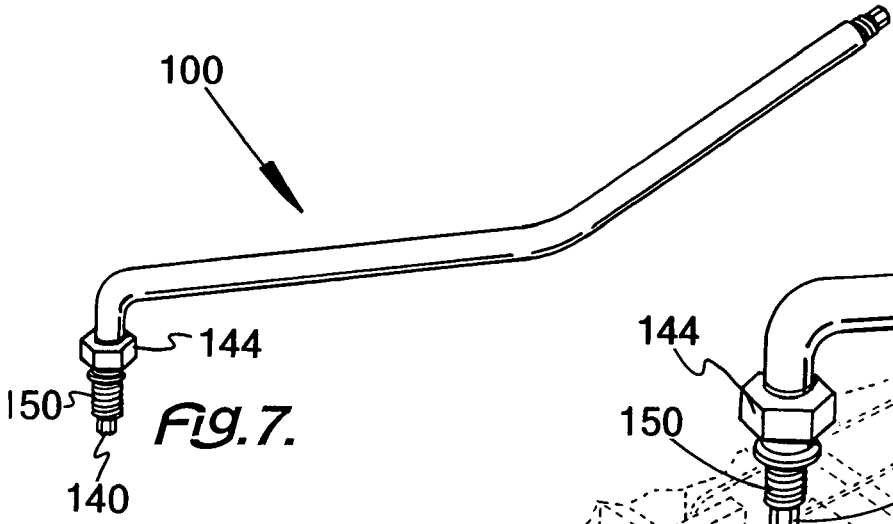
FIG. 7 depicts a perspective view of the wrench tremolo bar 100 of this invention, with a double female lock nut 144.
Figure 8:
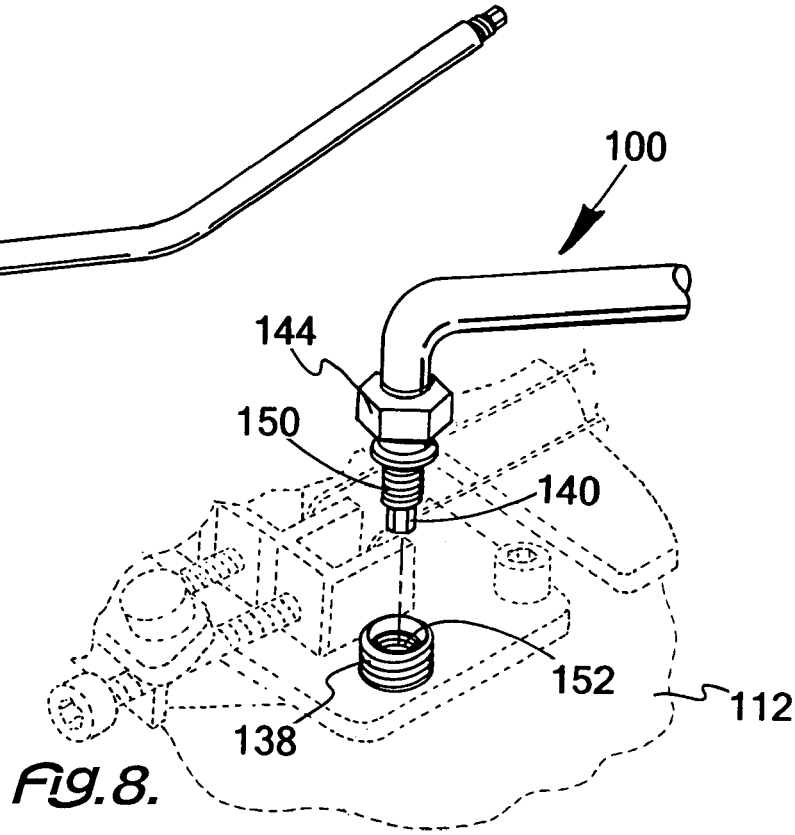
FIG. 8 depicts a perspective view of the wrench tremolo bar 100 of this invention, as it is mounted on guitar 112.

In FIG. 7 and FIG. 8, another option for attaching wrench tremolo bar 100 to the guitar 112 is an elongated female locknut 144. Locknut 144 is of sufficient length to contact and mesh with both expanded bar threads 150, which are above mounting threads 108, and male mounting threads 138 on guitar 112.

Within male mounting threads 138 are the interior female mounting threads 152, which are adapted to receive bar mounting threads 108. After bar mounting threads 108, are placed in threaded relation with female mounting threads 152 and wrench tremolo bar 100 is properly positioned as desired by a guitarist, female locknut 144 is placed in threaded relation with expanded bar threads 150 and male mounting threads 138 on guitar 112, thereby securing wrench tremolo bar 100 in a desired position.

Figure 9:
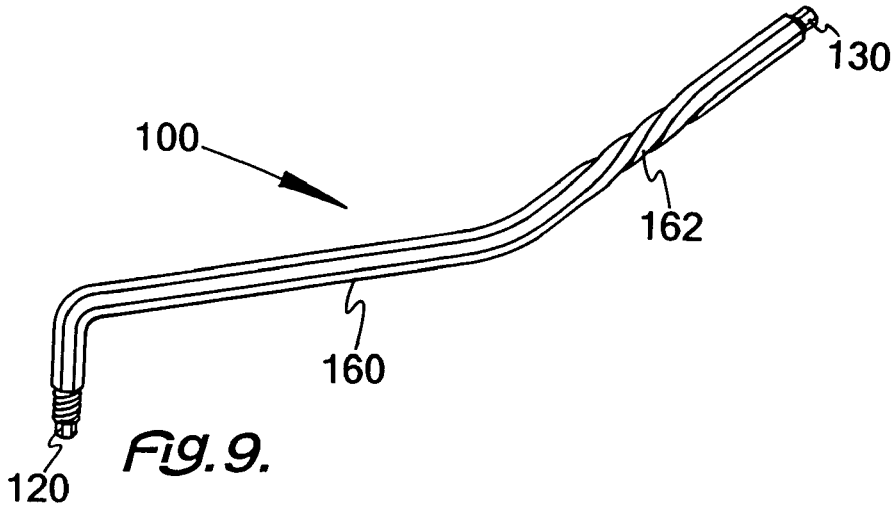
FIG. 9 depicts a perspective view of the wrench tremolo bar 100 of this invention, with a hexagonal linear stock material 160.

With FIG. 9, wrench tremolo bar 100 is depicted as formed from a hexagonal linear stock material 160. This is useful for decorative purposes, which may be accented by a twist section 162. Twist section 162 is near bridge Allen wrench 130.

Figure 10:
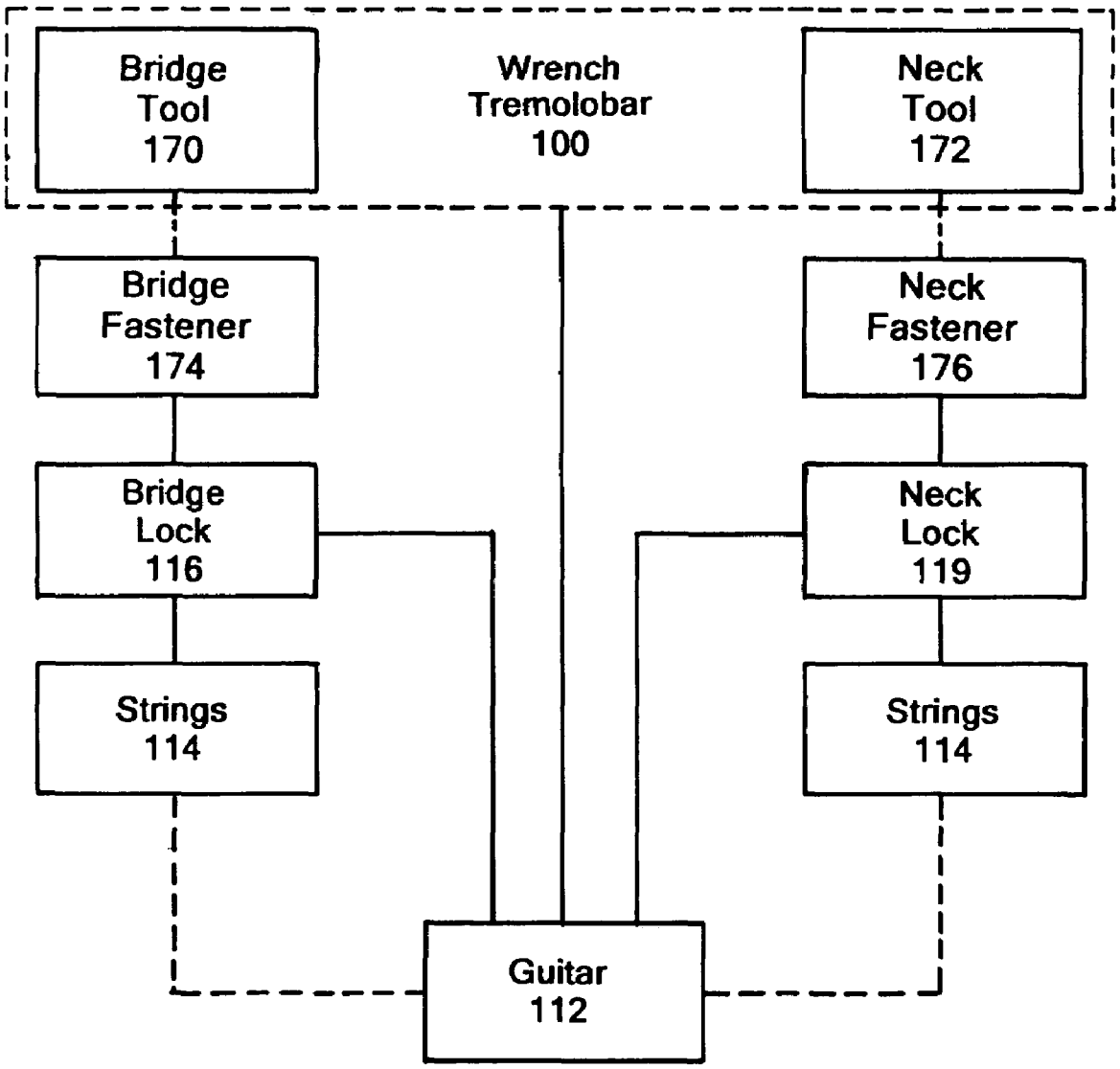
FIG. 10 depicts a block diagram of the wrench tremolo bar 100 of this invention, in position on guitar 112.

In FIG. 10, other designs of wrench tremolo bar 100, as mounted on guitar 112, are possible. Different cross sections of the wrench tremolo bar may be shown as desired. Different tools on each end of wrench tremolo bar 100 are patterned as desired for a particular guitar 112, depending on the fasteners, which may be used in place of bridge Allen screw 136, for example. Thus, the wrench tremolo bar 100 is very useful.

Tools include bridge tool 170 at one end of wrench tremolo bar 100 and neck tool 172 at the other end of wrench tremolo bar 100. Neck tool 172 and bridge tool 170 are adjusted, depending on the fasteners for guitar 112. Neck tool 172 may even include neck Allen wrench 120.

Neck tool 172 and bridge tool 170 may be the same or different, depending on the fasteners for guitar 112. Bridge fasteners 174 and neck fasteners 176 may be the same or different. Bridge fasteners 174 are on bridge lock 116, and neck fasteners. Neck fastener 176 are on neck lock 119. Strings 114 run from bridge lock 116 to neck lock 119. Neck fasteners 176 hold strings 114 on neck lock 119, while bridge fasteners 174 hold strings 114 on bridge lock 116.

With the wrench tremolo bar 100 of this invention with which has tool 170 on the end thereof, it is quite possible to change a guitar string 114 during the performance, without stopping the performance. It thus follows it is possible to change a guitar string 114 during a rehearsal without stopping the rehearsal. Such a quick change provides a tremendous advantage to the guitarist and the other musicians present. It also cuts down on waste under tremendously expensive studio time.

With FIG. 10, the wrench tremolo bar 100 on guitar 112 has a wide variety of shapes. The cross section of wrench tremolo bar 100 has any suitable shape, which permits playing of guitar 112 with wrench tremolo bar 100 in place thereon. The shape can be polygonal, elliptical, circular, or another operable shape.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. In a guitar having a tremolo bar releasably mounted thereon, the improvement comprising:

(a) the tremolo bar having a first bar end oppositely disposed from a second bar end;

(b) the tremolo bar having a tool on at least the first bar end thereof in order to form a wrench tremolo bar and to facilitate tuning, changing or replacing of a guitar string;

(c) a lock nut assembly securing the wrench tremolo bar to the guitar;

(d) the lock nut assembly including an elongated female locknut;

(e) the wrench tremolo bar having male mounting threads adjacent to the wrench at the first end;

(f) the wrench tremolo bar having expanded bar threads adjacent to the male mounting threads and oppositely disposed from the wrench at the first end;

(g) the guitar having female guitar threads adjacent to a bridge of the guitar to receive the male mounting threads;

(h) the guitar having male guitar threads on an outside of the female guitar threads; and (i) the elongated female locknut receiving both the female guitar threads and the expanded bar threads in order to secure the wrench tremolo bar in a desired position.

2. The guitar of claim 1 further comprising the tool being an Allen wrench.

3. The guitar of claim 2 further comprising the tool being a neck Allen wrench on the first bar end and a bridge Alien wrench on the second bar end.

4. The guitar of claim 3 further comprising the neck Allen wrench and the bridge Allen wrench different sizes.

5. The guitar of claim 4 further comprising the second tool being a neck Allen wrench and the first tool being a bridge Allen wrench.

6. The guitar of claim 4 further comprising:

(a) the wrench tremolo bar being formed from a hexagonal linear stock material;

(b) the second tool being a neck Allen wrench and the first tool being a bridge Allen wrench; and (c) a twist section in the wrench tremolo bar being near the neck Allen wrench.

7. The guitar of claim 4 further comprising the wrench tremolo bar having a cross section selected from the group consisting of a polygonal cross section, an elliptical cross section, and a circular cross section.

8. The guitar of claim 4 further comprising the tremolo bar having a hexagonal cross section with a twist section in the wrench tremolo bar being near the neck Allen wrench.

9. The guitar of claim 4 further comprising:

(a) the neck Allen wrench and the bridge Allen wrench being adapted to cooperate with the fasteners for strings on the guitar; guitar; and (b) the neck Allen wrench and the bridge Allen wrench facilitating tuning, changing or replacing of at least one of the strings on the guitar; and (c) the neck Allen wrench and the bridge Allen wrench being the same or different sizes.

10. In a guitar having a tremolo bar releasably mounted thereon, the improvement comprising:

(a) the tremolo bar having a first bar end oppositely disposed from a second bar end;

(b) the tremolo bar having a tool on at least the first bar end thereof in order to form a wrench tremolo bar and to facilitate tuning, changing or replacing of a guitar string;

(c) the tremolo bar being magnetized;

(d) a lock nut assembly securing the wrench tremolo bar to the guitar;

(e) the lock nut assembly including an elongated female locknut;

(f) the wrench tremolo bar having male mounting threads adjacent to the wrench at the first end;

(g) the wrench tremolo bar having expanded bar threads adjacent to the male mounting threads and oppositely disposed from the wrench at the first end;

(h) the guitar having female guitar threads adjacent to a bridge of the guitar to receive the male mounting threads;

(i) the guitar having male guitar threads on an outside of the female guitar threads; and (j) the elongated female locknut receiving both the female guitar threads and the expanded bar threads in order to secure the wrench tremolo bar in a desired position.

11. The guitar of claim 10 further comprising the tool being an Allen wrench.

12. The guitar of claim 11 further comprising the tool being a neck Allen wrench on the first bar end and a bridge Allen wrench on the second bar end.

* * * * *